United States Patent [19]

Joussemet

[11] 4,365,778

[45] Dec. 28, 1982

[54] ROD-TYPE SUPPORT FOR SUSPENSION SYSTEMS FOR SHELVES AND SIMILAR OBJECTS

[76] Inventor: Pierre Joussemet, 5, boulevard Suchet, 75016 Paris, France

[21] Appl. No.: 95,800

[22] Filed: Nov. 19, 1979

[30] Foreign Application Priority Data

Oct. 23, 1979 [FR] France ..... 79 26211

[51] Int. Cl.[3] ..... F16M 13/00

[52] U.S. Cl. ..... 248/229; 248/230

[58] Field of Search ..... 248/229, 230; 403/187, 403/188, 201

[56] References Cited

U.S. PATENT DOCUMENTS

| | | | |
|---|---|---|---|
| 884,772 | 4/1908 | Sorensen | 248/229 |
| 1,170,684 | 2/1916 | Schlieckert | 228/230 |
| 1,394,464 | 10/1921 | Bentley | 403/187 X |
| 2,365,935 | 12/1944 | Boggs | 248/229 |
| 2,574,007 | 11/1951 | Anderson | 248/229 X |
| 2,620,152 | 12/1952 | Niles | 248/230 |
| 2,696,996 | 12/1954 | Engelhardt | 248/230 X |
| 3,157,378 | 11/1964 | Blum | 248/230 |

*Primary Examiner*—William H. Schultz

*Attorney, Agent, or Firm*—Robert E. Burns; Emmanuel J. Lobato; Bruce L. Adams

[57] ABSTRACT

This support or coupling device for suspending objects such as shelves or the like from rods comprises a front member formed with a rod-receiving groove and a back member for pressing and locking the rod in this groove. The two members are assembled by means of a screw-threaded cylindrical projection formed on one of them and of a tapped hole engageable by this projection. A central inner element projects from the inner face of the back member and the arrangement is such that this back member bears at three spaced and aligned points on the rod. A single handtool consisting of a key provided with a pair of studs is used for tightening and loosening the assembly by engaging these studs into corresponding holes formed in the back member. A disk-like member formed with an integral screw-threaded plug is used for fastening the object to the device by engaging this plug into a matching tapped hole formed in the front member. This front member may also be provided with two opposed back members for clamping two rods disposed at right angles to each other and fitted in two separate grooves formed in the front member.

13 Claims, 5 Drawing Figures

ROD-TYPE SUPPORT FOR SUSPENSION SYSTEMS FOR SHELVES AND SIMILAR OBJECTS

BACKGROUND OF THE INVENTION

This invention relates to a support or hanger for a rod-type suspension or shelving system comprising a rod extending between two spaced anchoring members.

DESCRIPTION OF THE PRIOR ART

Supports of this general character are well-known in the art and comprise for example a front portion and a back portion encompassing the rod. These portions are rigidly assembled by means notably of clamping or tightening means and each portion is provided with a notch or groove engaged by the rod. One portion is further provided with means for fixing an object which is thus fastened to or suspended from the rod.

Under these conditions, the two portions of the support are assembled with each other by clamping means so as to bind the rod and be detachably secured thereto. Each portion comprises a semi-circular sectioned groove and the two grooves cooperate to constitute a rod receiving passage. However, to produce a reliable grip the two grooves must be formed with precision for accommodating the cross-sectional contour of the rod, and this requirement cannot be met unless precision machining is resorted to, inasmuch as the use of clamping means in the form of additional members such as screws or the like likely to be lost or loosened precludes any subsequent adjustment. This obviously increases the final cost of the shelf support without warranting its reliable anchorage to the rod. Moreover, the clamping screws can easily be removed by using any ordinary tool such as a screwdriver and this constitutes an additional inconvenience. Finally, clamping screws have an unaesthetic appearance.

In devices of this type the fastening means are ill suited for the specific case of an object consisting or, or comprising, or associated with, a vertical plate or board, notably a vertical plate or board in most instances more or less smooth, without any projecting element.

SUMMARY OF THE INVENTION

It is the essential object of the present invention to avoid the above-mentioned inconveniences by providing a more reliable and easier fastening of the support to the rod while reducing the cost of the support while improving its aesthetic appearance, holding property and versatility.

For this purpose, the present invention provides a support or hanger of the type broadly set forth hereinabove, characterised in that only one of the two portions constituting the support is provided with a groove opening towards the registering joint or inner face of the other, grooveless portion of the support, said groove being adapted to be engaged by the rod, the other portion of the support being provided with means for locking the rod in the bottom of said groove.

According to another feature of this invention the means for clamping the two portions against each other are integral parts of said portions, without resorting to any additional element.

According to a complementary feature characterising this invention, the object to be fastened comprises a plate in which a fastening hole or notch is formed, and the fastening means consist of a disk provided with a stud projecting from one face thereof and engageable through said hole or notch in a corresponding fastening hole formed in the front portion of the support.

It is clear that this stud may comprise for example a screw-threaded portion engageable in a tapped retaining hole, in order to improve the reliability of the assembly.

According to another feature of the present invention, the rod is pressed against the groove bottom by means exerting the necessary pressure at three spaced contact points aligned in a direction parallel to the rod axis.

It is thus evident that a plate or object comprising a sliding plate without any projecting portion may safely be associated with the support and that the rod is locked against the groove bottom in the safest and simplest way, irrespective of the weight of the objects associated with the support.

Another characteristic feature of the instant invention is that the handtool necessary for assembling and disassembling the support of the invention consists of a two-stud key. Thus, the screwed and locked portions cannot be disassembled by using an ordinary handtool, since only the specific handtool intended for this operation can be used for this purpose.

DESCRIPTION OF THE PREFERRED EMBODIMENTS

Figure 2:
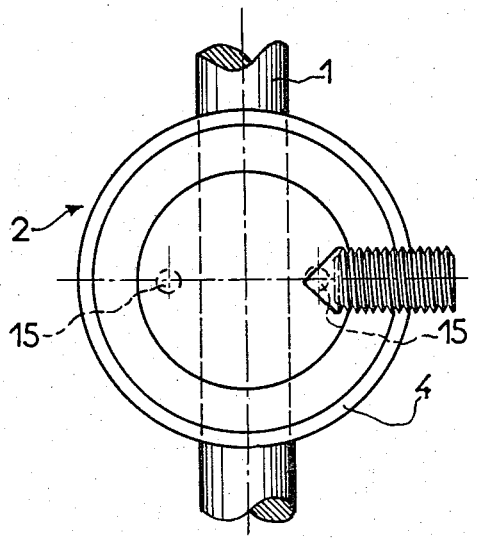
FIG. 2 is an elevational view of the device of FIG. 1.

Referring first to FIGS. 1 to 5 of the drawings, the suspension device or hanger according to this invention is adapted to cooperate with a known suspension member comprising a rod 1 extending vertically between two spaced anchoring members (not shown).

This suspension device 2 comprises two substantially cylindrical members 3 and 4, this shape being preferred but not to be construed as limiting the scope of the invention, namely a back member 3 and a front member 4 disposed on either side of rod 1 and adapted in their final or assembled positions to engage each other by their registering or inner flat faces 5*a* and 5*b*, respectively.

These two members 3, 4 are assembled with each other by using clamping means adapted to be actuated by using a suitable handtool 6, notably a two-stud key or spanner. The support 2 comprises in its front member 4 a groove 8 cut in its rear face 5*b* which opens towards the opposite, grooveless face 5*a* of back member 3. The rod 1 engages the groove 8 of which the depth is substantially equal to the rod thickness.

The grooveless back member 3 comprises means for locking the rod 1 against the bottom 9 of groove 8 when the two members 3 and 4 are assembled with their registering faces 5*a* and 5*b* contacting each other.

The means for clamping the two members 3 and 4 are formed integrally therewith, so that no additional components are required for this purpose. More particularly, these clamping means comprise a screw-threaded projection 10 and a complementary tapped hole 11 formed the one on member 3 and the other in member 4. More specifically and preferably, the male screw-threaded element 10 is formed on a cylindrical portion 12 thereof which projects from its face 5b in the central area of the member so as to define the groove 8. The tapped hole 11 is a blind hole formed in the other member 3 and constitutes therein an annular cavity which opens at the flat face 5a of this member.

When the two members 3, 4 are assembled by using the screw-threaded portions 10 and 11, the faces 5a and 5b are moved towards each other until they contact each other so as to close the groove 8 and bring the locking means to the operative position.

The locking means consist essentially of a central element 14 projecting from member 3 into the groove 8, the end face 14a of this element being coplanar with the face 5a of member 3.

More particularly, the projecting element 14 is housed in the cavity 13 of member 3 and its height is such that when the members 3, 4 are assembled and contact each other the free end face of element 14 bears against the rod 1 received in groove 8 so as to press same firmly against the bottom 9 of said groove.

The outer peripheral portion of face 5a coplanar with the end face 14a will thus also engage the rod 1 which is thus pressed with force against the bottom 9 of groove 8 due to the pressure exerted by the element 14 against the rod 1 at three aligned and spaced points, namely two points on face 5a and a third point consisting of the end face 14a of said projecting element 14, this alignment being parallel to the axis of rod 1.

In a first and preferred form of embodiment the means for clamping the members 3 and 4 comprise a pair of holes 15 formed in the grooveless member 3 and disposed on its face opposite the face 5a, these holes 15 being adapted to be engaged by a corresponding handtool 6, notably a two-stud key, for tightening or loosening the two members 3 and 4, by screwing in or out the screw-threaded portion with respect to the tapped hole 11.

According to the instant invention, the handtool 6 consists preferably but not exclusively of a metal strip 16 having formed at either end at least one outwardly projecting ear 17 and on its face opposite said ears 17 a pair of projecting studs 18 the relative spacing of which corresponds to that of the holes 15 formed in the grooveless member 3. Thus, when the two-stud key 6 is engaged into said holes 15 of member 3 the screw-threaded portion 10 can be screwed in or out with respect to the tapped hole 11 so as to tighten or loosen the two members 3 and 4 in relation to each other.

Preferably, the distance D between the holes 15 is as great as possible, notably by forming them tangent or close to the inner peripheral wall of the tapped cavity 13.

The distance D between the axes of the pair of holes 15 is preferably the same for all the pairs of holes 15 of members 3 so that the same handtool can be used for tightening supports having different dimensions.

Likewise, the distance between the ears 17 is also as great as possible to provide, without becoming unduly awkward, a convenient grip and a lever arm facilitating the support tightening and loosening operations.

Figure 1:
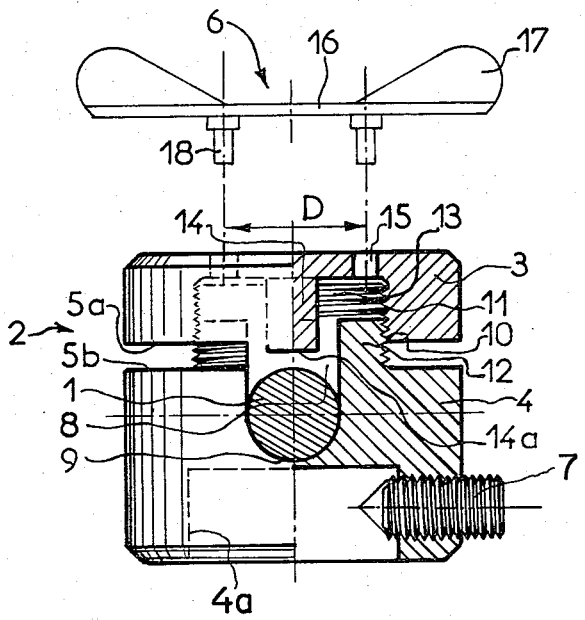
FIG. 1 is a part-sectional and plan view from above of a first form of embodiment of the invention.

The front member 4 also comprises means for fastening an object which, in the form of embodiment shown in FIGS. 1 and 2, may be a pipe or bar received in a recess 4a in the outer end face of member 4 and secured by a threaded stud 7. In the embodiment shown in FIG. 3, an object to be fastened is shown as a rigid, more or less flat, plate or board 19 of relatively reduced thickness, for example the vertical wall of the object, a shelf lipping, or the like.

A hole or notch 20 is formed in the plate or board 19 for fastening same by means of the support of this invention.

The front member 4 further comprises on its front face 21 opposite face 5b a blind hole 22 adapted to receive the plate fastening member, this hole 22 being somewhat spaced from the groove 8 and tapped to a diameter smaller than the diameter of hole 20, so that when these two holes are in axial alignment with each other a free shoulder 23 is formed on face 21.

The fastening means consist in this case of a disk 24 notably of a diameter close to or preferably somewhat smaller than that of members 3, 4 and carries on one face an integral coaxial plug 25 comprising firstly a cylindrical portion 26 adjacent the disk 24 which has a diameter slightly smaller than that of said hole 20 in plate 19 so as to extend therethrough and a length (in the axial direction) substantially equal to the thickness of plate 19, and secondly a screw-threaded portion 27 constituting the axial extension of said cylindrical portion 26, opposite the disk 24. This screw-threaded portion 27 has a diameter slightly smaller than that of said cylindrical portion 26 and is adapted to engage the tapped blind hole 22 of a depth sufficient for accomodating this screw-threaded portion 27.

It is clear that when the screw-threaded portion 27 of plug 25 is screwed home in the tapped hole 22, its cylindrical portion 26 fits accurately in the hole 20 of plate 19, and eventually engages the shoulder 23 with its face opposite the disk 24. Thus, the plate 19 is firmly pressed against the front member 4 and retained by the disk 24. To improve the reliability of the fastening means, the front face 21 of member 4 has formed on its annular surface a relatively great number of radial projections or teeth 29 surrounding the hole 22.

To facilitate the tightening of disk 24, that is, of its screw-threaded portion 27 in the blind tapped hole 22, the disk 24 comprises on its face opposite the one provided with the plug 25 a pair of blind holes 15 disposed symmetrically in relation to the axis of plug 25; these holes 15 have preferably the same relative spacing as the pair of holes 15 of member 3 so that the same handtool 6 provided with studs 18 as that mentioned in the foregoing for screwing in or out this member 3 can be used for turning the disk 24.

Figure 3:
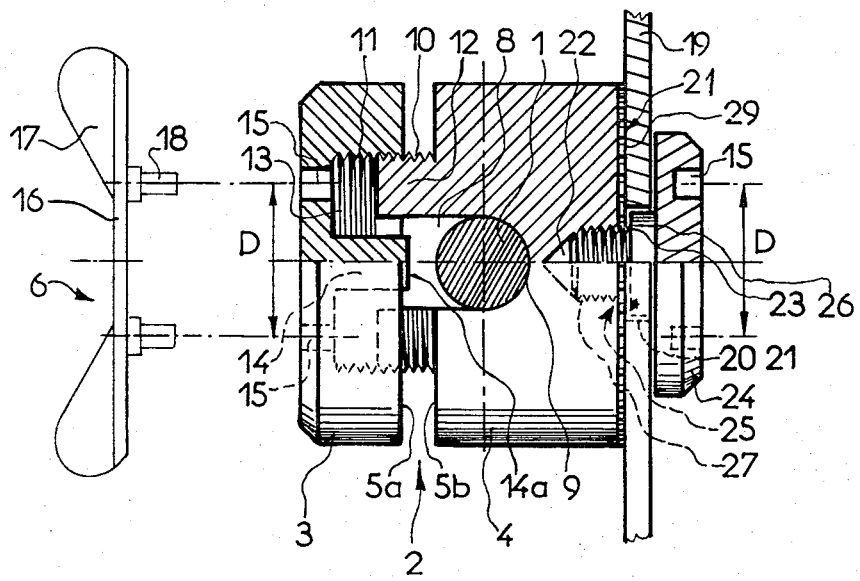
FIG. 3 is a part-sectional and plane view from above showing a second form of embodiment of the invention.
Figure 4:
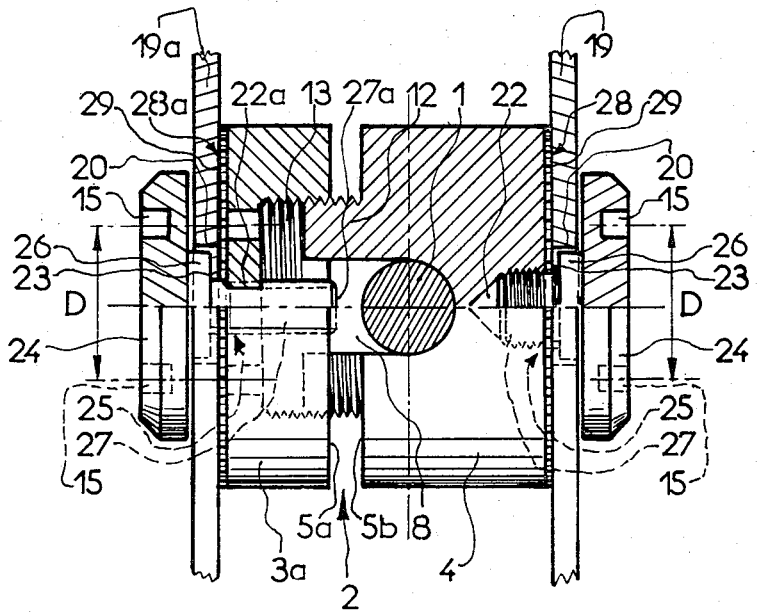
FIG. 4 is a view similar to FIG. 3 showing a third form of embodiment of the invention.

According to another modified form of embodiment of the invention, as illustrated in FIG. 4, the fastening support 2 is designed with a view to carry two objects, each object being fastened by means of a plate 19 or 19a. As shown, each object is firmly secured to one of the opposed faces of support 2, notably the outer face 28 of front member 4 or the opposite outer face 28a of back member 3a. In the form of embodiment illustrated the plate 19 is secured to member 4 by using the same means, notably a disk 24, as that used in the preceding form of embodiment sa described hereinabove with reference to FIG. 3.

The back member 3a comprises in its centre, in lieu of a projecting stud 14, a retaining hole 22a similar to the corresponding hole 22 formed in front member 4, this retaining hole 22a being preferably tapped and engageable by the screw-threaded portion 27 of a plug 25 formed integrally with a disk 24 constituting the fastening means.

If desired, the screw-threaded portion 27 of plug 25 may further have the function devolved to the projecting element 14, as explained hereinabove.

When the cylindrical portion 26 of plug 25 is introduced through the hole 20 of plate 19*a*, its face opposite the disk 24 bears against the shoulder 23, and the plate 19*a* is thus clamped against the back member 3*a* having its rear face 28*a* also provided with an annular series of radial teeth 29.

The height or axial length of plug 25 is such that in this bearing condition, i.e, with the cylindrical portion 26 engaging the shoulder 23, the screw-threaded portion 27 is housed in the cavity 13 formed in the back member 3*a* and if it is desired, in a modified form of embodiment, that said portion 27 also acts as a projecting element 14, the height or axial length of plug 25 may be such that when members 3*a* and 4 are clamped to their assembled positions, the free end of screw-threaded portion 27 bear firmly against the rod 1 passing through the groove 8, so as to press the rod 1 in turn against the bottom 9 of said groove.

Under these conditions, the outer peripheral portion of face 5*a* is coplanar with the end face 27*a* of the screw-threaded portion 27 and therefore bears likewise against the rod 1 which is thus firmly pressed in groove 8 by the force exerted by said member 3*a* at three contact points aligned in a common direction parallel to the axis of rod 1, two contact points being located on face 5*a*, the third point consisting of end face 27*a*.

The fastening means, notably the disk 24, are tightened or loosened by using the same handtool 6.

Figure 5:
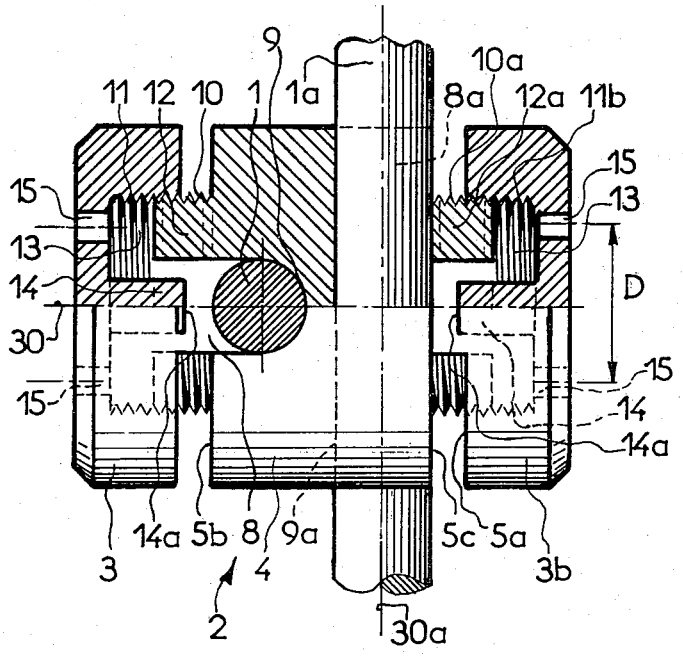
FIG. 5 is a view similar to FIG. 4 showing a fourth form of embodiment of the invention.

According to another form of embodiment of the present invention shown in FIG. 5, the support device 5 is adapted to assemble the rod 1 with another similar rod 1*a* extending at right angles thereto, with rod 1*a* disposed horizontally and rod 1 vertically, notably for constructing a tubular scaffolding.

To this end, the front member 4 comprises a second groove 8*a* similar to groove 8, but has its longitudinal axis 30*a* directed at right angles to the longitudinal axis 30 of groove 8.

This perpendicular groove 8*a* is cut in and opens at the face 5*c* opposite the face 5*b*. The second rod 1*a* is engaged in this groove 8*a* having a depth corresponding to the thickness of rod 1*a*, as in the case of rod 1 through groove 8.

The front member 4 comprises likewise in its face 5*c* a projecting element 12*a* formed with external threads 10*a* engageable in a tapped hole 11*b* formed in another front member 3 identical with back member 3 for locking the rod 1 in position, as already explained in the foregoing with reference to the form of embodiment of FIG. 3. The members 3*b*, 4 are thus provided with the same rod-locking means as those already described hereinabove in the case of rod 1.

Thus, the means for locking the rod 1*a* against the bottom 9*a* of groove 8*a* when the two members 3*b*, 4 are assembled with each other are similar to those provided for rod 1 and consist of the end face 14*a* of projecting element 14 and of two areas of the coplanar face 5*c*.

It will be readily apparent to those conversant with the art that the additional member 3*b* may consist of the same component element as that constituting the member 3, so that a smaller number of different component elements are required and costs are reduced accordingly.

The member 3*b* engaged by rod 1*a* can be tightened and loosened by using the same handtool 6 already described hereinabove.

It is also evident that instead of the back members 3 and 3*b* described hereinabove, a back member such as 3*a* described with reference to the modified form of embodiment shown in FIG. 4 may be used. Thus, it is possible not only to assemble the two rods 1 and 1*a* at right angles to each other by means of the support device 2 of FIG. 5, but also to secure an object of the type set forth by means of a plate 19 on one face of said support 2, or two objects of this type, by means of corresponding plates 19, notably to the two opposite faces of the support device 2.

Any combination of the component elements of the support device of this invention whether interchangeable or so designed that they can be rendered interchangeable, is also to be regarded as an integral part of this invention.

On the other hand, it will readily occur to those skilled in the art that many other forms of embodiment of this invention may be contemplated without departing from the basic principles of the invention. Thus, notably, the disk 24 may have a different configuration, for example an oval, polygonal or other shape, with or without decorations on its face provided which the two holes 15.

What is claimed as new is:

1. A rod-type support device for supporting a shelf or other object on a rod extending between two spaced anchoring means, the support device comprising a front member and a back member receiving the rod between them, the front member only having in its rear face a groove to receive the rod, means for assembling the front and back members to clamp the rod between them and means for fastening to said support device said object to be supported, said assembling means comprising an externally threaded cylindrical portion projecting integrally from the rear face of said front member and bifurcated by said groove and a complementary internally threaded cavity formed in the front face of said back member into which said externally threaded projecting portion of said front member is screwed, means for rotating said back member relative to said front member to screw it onto said externally threaded projecting portion of said front member, and a stud provided centrally of said cavity of said back member and having an inner end in the same plane as an annular front face of said back member around said cavity, said rod being pressed against the bottom of said groove in said front member by pressure exerted at three spaced contact points aligned in a direction parallel to the rod axis, a first point consisting of the inner end of said stud and the other two points consisting of diametrically opposed portions of said annular front face of said back member.

2. A rod-type support device as claimed in claim 1, wherein the axes of said holes are spaced as far as possible from each other, and this relative spacing is the same for like support devices of different sizes so that the same handtool can be used for a complete range of support devices.

3. A rod-type support device as claimed in claim 2, wherein said object to be supported comprises a plate formed with a fastening hole or notch, and wherein said means for fastening this object to the device, consists of a disk carrying on one face a stud adapted to pass through said fastening hole and to engage a tapped retaining hole formed in said front member.

4. A rod-type support device as claimed in claim 2, wherein said stud comprises on the one hand a cylindrical portion adjacent said disk and adapted to bear against an annular shoulder formed on said front member and on the other hand a screw-threaded portion adapted to engage internal screw-threads formed in said retaining hole of said front member.

5. A rod-type support device as claimed in claim 4, wherein the front face of said front member has an annular set of retaining teeth formed thereon.

6. A rod-type support device as claimed in claim 5, wherein said disk has formed on its face opposite the face provided with said stud a pair of holes adapted to be engaged by the projections of said handtool.

7. A rod-type support device as claimed in claim 3, wherein said back member has a tapped retaining hole opening into said cavity centrally thereof and wherein second like means for fastening an object to the support device comprises a threaded stud adapted to pass through said retaining hole of said back member and to extend into said cavity to engage said rod, thereby constituting said stud provided centrally of said cavity of said back member.

8. A rod-type support device as claimed in claim 1, wherein said means for rotating said back member in relation to said front member and thereby assembling said members with each other comprises a pair of holes formed in the back face of said back member, said holes being engageable simultaneously by projections on a handtool.

9. A rod-type support device according to claim 8, wherein said groove in said front member has a depth equal approximately to the thickness of said rod.

10. A rod-type support device as claimed in claim 8, wherein said front member has on its front face a second rod-receiving groove perpendicular to said rod-receiving groove on its rear face and a second like externally threaded cylindrical portion projecting integrally from said front face of said front member, and wherein a second member like said back member is screwed onto said second externally threaded cylindrical portion to clamp a second rod in said second rod-receiving groove.

11. A rod-type support device for supporting a shelf or other object in a suspension system comprising two rods disposed at right angles to one another, the support device comprising a main body having opposite faces in which are provided grooves to receive said rods, the groove in one face being disposed at right angles to the groove in the other face, an externally threaded cylindrical portion projecting integrally from each of said opposite faces and bifurcated by said grooves respectively and two clamping members having respectively a complementary internally threaded cavity into which said externally threaded projecting portions of said main body are screwed and an annular face portion surrounding said cavity, and means for rotating said clamping members relative to said main body to screw said clamping members on said externally threaded projecting portions and thereby clamping said rods respectively between said clamping members and said main body, each of said rods being pressed against the bottom of the respective groove in said main body by pressure exerted by spaced contact points aligned in a direction parallel to the rod axis and consisting of diametrically opposed portions of said annular face of said respective clamping member.

12. A rod-type support device as claimed in claim 11, wherein each of said clamping members has a stud projecting centrally in said cavity and having an end face in the plane of said annular face to engage and press said respective rod at a third contact point between said contact points of said diametrically opposed portions of said annular face.

13. A rod-type support device as claimed in claim 11, wherein each of said clamping members has an outer face perpendicular to the axis of said cavity and wherein said means for rotating said clamping member comprises diametrically spaced holes in said outer face and a tool having projections received in said holes.

* * * * *